US010279490B2

(12) United States Patent
Gilbert et al.

(10) Patent No.: US 10,279,490 B2
(45) Date of Patent: May 7, 2019

(54) UTILITY KNIFE WITH PIVOTING HEAD ASSEMBLY

(71) Applicants: James Gilbert, Catlett, VA (US); Michael L. Marshall, Washington, DC (US); Paola Moya, Washington, DC (US)

(72) Inventors: James Gilbert, Catlett, VA (US); Michael L. Marshall, Washington, DC (US); Paola Moya, Washington, DC (US)

( * ) Notice: Subject to any disclaimer, the term of this patent is extended or adjusted under 35 U.S.C. 154(b) by 112 days.

(21) Appl. No.: 14/620,531

(22) Filed: Feb. 12, 2015

(65) Prior Publication Data

US 2016/0184999 A1 Jun. 30, 2016

Related U.S. Application Data

(63) Continuation-in-part of application No. 29/517,346, filed on Feb. 12, 2015, now Pat. No. Des. 784,108, and a continuation-in-part of application No. 14/157,187, filed on Jan. 16, 2014, now abandoned, which is a continuation-in-part of application No. 13/797,036, filed on Mar. 12, 2013, now abandoned.

(60) Provisional application No. 61/681,461, filed on Aug. 9, 2012.

(51) Int. Cl.
*B26B 1/08* (2006.01)
*B26B 1/10* (2006.01)

(52) U.S. Cl.
CPC . *B26B 1/10* (2013.01); *B26B 1/08* (2013.01)

(58) Field of Classification Search
CPC .... B26B 1/10; B26B 1/08; B26B 1/02; B26B 5/00
See application file for complete search history.

(56) References Cited

U.S. PATENT DOCUMENTS 1,521,533 A * 12/1924 Henderson ..... B26B 5/00 30/317
1,780,453 A * 11/1930 Wenalan ..... A47J 19/04 30/305
2,458,200 A 1/1949 Renfroe et al.
2,469,373 A 5/1949 Feather
2,787,059 A * 4/1957 Wingen ..... B26B 3/06 30/342
3,773,375 A 11/1973 Nehls
4,034,946 A * 7/1977 Zimmer, Jr. ..... F21V 21/30 248/183.2

(Continued)

*Primary Examiner* — Kenneth E Peterson
*Assistant Examiner* — Liang Dong
(74) *Attorney, Agent, or Firm* — Blank Rome LLP

(57) ABSTRACT

A utility knife is provided that has an elongated main body portion and a head assembly that is separate from the main body portion. The main body portion has a handle assembly. A main body fastening mechanism is provided at one distal end of the handle assembly, and a handle assembly fastening mechanism is provided at one end of the handle assembly. A threaded pin pivotally fastens the main body portion to the head assembly by connecting the main body fastening mechanism to the handle assembly fastening mechanism. Accordingly, the head assembly can pivot with respect to the main body portion and handle assembly, so that the utility knife can be configured to cut an object at different angles, which can be particularly useful for the knife to fit in a tight cutting space.

12 Claims, 10 Drawing Sheets

(56) References Cited

U.S. PATENT DOCUMENTS

| | | | | |
|---|---|---|---|---|
| 6,321,455 | B1 * | 11/2001 | Burchell | B26B 5/00 30/321 |
| 7,752,760 | B2 | 7/2010 | Baskar et al. | |
| 8,359,755 | B1 | 1/2013 | Laube | |
| 2004/0163503 | A1 * | 8/2004 | Hsien | B25B 7/00 81/177.8 |
| 2007/0084416 | A1 | 4/2007 | Liao | |
| 2008/0190376 | A1 | 8/2008 | Matsumoto | |
| 2009/0101076 | A1 | 4/2009 | Khubani et al. | |
| 2012/0014744 | A1 * | 1/2012 | Lin | F16M 11/06 403/91 |

* cited by examiner

UTILITY KNIFE WITH PIVOTING HEAD ASSEMBLY

RELATED APPLICATIONS

This application is a continuation-in-part of U.S. Design patent application Ser. No. 29/517,346, filed Feb. 12, 2015, and a continuation-in-part of U.S. patent application Ser. No. 14/157,187, filed Jan. 16, 2014, which is a continuation-in-part of U.S. patent application Ser. No. 13/797,036, filed Mar. 12, 2013, which claims the benefit of U.S. Provisional Application No. 61/681,461, filed Aug. 9, 2012. The entire contents of each of those applications is incorporated herein by reference.

BACKGROUND OF THE INVENTION

Field of the Invention

The present invention relates to a utility knife. More particularly, the present invention relates to a utility knife that can pivot to enable use in different angles and/or to fit into tight spaces.

Background of the Related Art

Utility knifes are used for a variety of general or utility purposes. Utility knifes can have a number of features, including a retractable blade, replaceable blades, blade storage compartments, and breakaway blades. Most utility knifes are made of metal or rigid plastic. This makes the knife extremely durable and enables a large force to be applied to the knife by the user, resulting in a large cutting force. However, the knife is difficult to use in tight spaces, especially when a large cutting force is still needed. As a result, a right-handed user may be forced to use his/her left (weaker) hand to make a cut.

Carpet cutting is one illustrative, non-limiting utility knife application that requires a large cutting force. During installation, carpet needs to be cut accurately to match the wall, object, or other obstacle surface against which it is being laid. It is best to make the carpet cut as close to the obstacle itself, to ensure the best fit. However, the obstacles do not always allow for sufficient space to make a clean cut, and it can be difficult or impossible for the utility knife to fit in a tight space. In particular, obstacles having recessed bottom surfaces, such as furniture and cabinetry, which can present significant challenges to obtaining a proper carpet cut and can slow work. For instance, many cabinets have a toe kick that is recessed with respect to the rest of the cabinet.

As a result, the installer must cut at an angle or pull the carpet away from the tight space of the obstacle and estimate the distance to the obstacle. Consequently there is a need for a utility knife that is durable and can be used to impart a large cutting force, but at the same time is able to be used in tight spaces.

SUMMARY OF THE INVENTION

Accordingly, it is an object of the invention to provide a durable utility knife that is extremely rigid in construction. It is a further object of the invention to provide a rigid, durable utility knife that can be easily utilized in tight spaces, such as at a cabinet toe kick or other surfaces that are difficult to reach. It is a further object of the invention to provide a durable utility knife that has a blade head assembly that can pivot transversely with respect to the knife handle body assembly.

A utility knife is provided that has an elongated main body portion and a head assembly that is separate from the main body portion. The main body portion has a handle assembly. A main body fastening mechanism is provided at one distal end of the handle assembly, and a handle assembly fastening mechanism is provided at one end of the handle assembly. A threaded pin pivotally fastens the main body portion to the head assembly by connecting the main body fastening mechanism to the handle assembly fastening mechanism. Accordingly, the head assembly can pivot with respect to the main body portion and handle assembly, so that the utility knife can be configured to fit in a tight cutting space.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
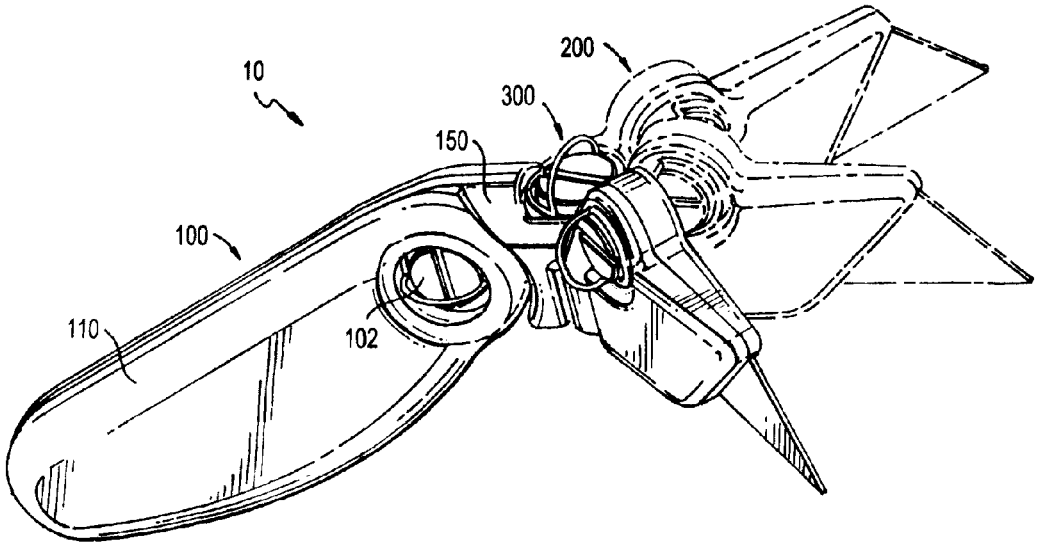
FIG. 1 is a perspective view the utility blade in accordance with the preferred embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Referring to the drawings. FIG. 1 shows a box cutter or utility knife 10 in accordance with a non-limiting example of the preferred invention. The utility knife 10 has a main body 100 and a head assembly 200, which are pivotally connected together at a fastening mechanism 300. The main body 100 includes a handle assembly 110 that is elongated and has a longitudinal axis. The handle assembly 110 is configured to fit in the palm of the user's hand, and has a rectangular shape with rounded corners.

The handle assembly 110 has a first proximal end 112 and a second distal end opposite the first end 112. A neck or main body fastening portion 150 is formed integrally with the main body 100 at the proximal end 112 of the handle assembly 110. The main body fastening portion 150 has a support portion 152 that is connected to the proximal end 112 of the main body 110. A ledge 151 is formed at the top of the support portion 152. The ledge 151 is relatively flat and is contiguous with the top circumferential surface of the handle assembly 110, but at a radial angle thereto whereby the longitudinal axis (shown) of the body 210 is at an angle with respect to the longitudinal axis (shown) of the handle 110. That angle is best shown by angle B in FIG. 2, and is preferably about 135°-155° (when the body 210 is planar with the handle 110), and most preferably 145°, though any suitable angle can be provided. When viewed from the top (FIG. 3), the support portion 152 is linear with the handle assembly 110. However, when viewed from the side (FIG. 2), the ledge 151 of the support 152 is at an angle with respect to the top of the handle assembly 110 (as noted in the prior sentence, the angle is preferably about 135°-155°, though any suitable angle can be provided). Thus, the user can rest his/her thumb or forefinger on the ledge 151 during use of the utility knife 10, whereby the support ledge 151 provides extra leverage for the user to exert a cutting force and to control operation of the utility knife 10.

The main body fastening portion 150 also includes a circular-shaped fastening shelf 158 that extends outward from the support portion 152. The shelf 158 is slightly elongated and has a top surface 153, a bottom surface 154, and a longitudinal axis. The shelf 158 is positioned on the support 152 to be at an angle with respect to the handle assembly 110 (as noted above, the angle is preferably about 135°-155°, though any suitable angle can be provided). Thus, the top surface 153 and longitudinal axis of the shelf 158 are at a desired angle with respect to the longitudinal axis of the handle assembly 110 (as stated, preferably about 135°-155°, though any suitable angle can be provided). The top surface 153 of the shelf 158 is relatively flat and slightly lower than the flat top ledge 151 of the support 152. The top support ledge 151 and the top shelf surface 153 are substantially parallel to one another and together form the top or upper surface of the main body fastening portion 150.

The bottom surface 154 of the fastening shelf 158 is jagged to form triangular-shaped alignment teeth. A through-hole 156 is formed through the center of the circular shelf 158, substantially perpendicular to the longitudinal axis of the shelf 158 and the linear top surface 153.

Figure 3:
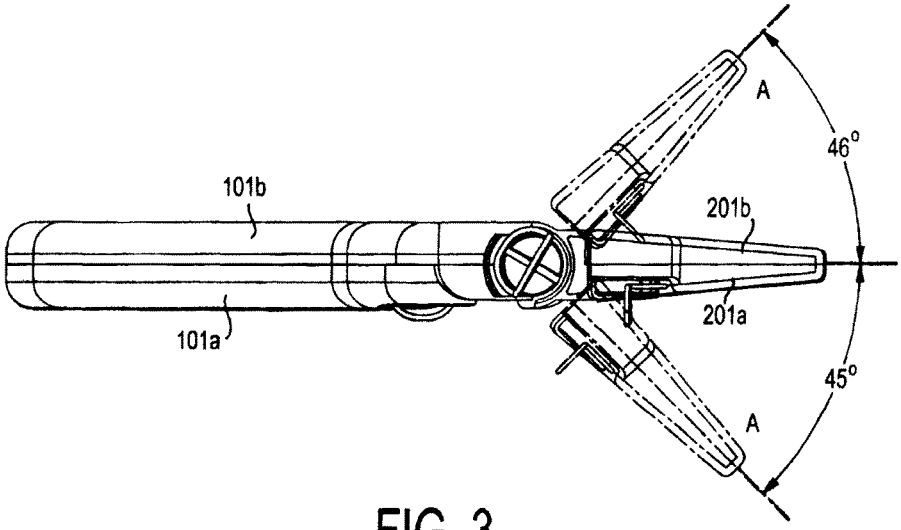
FIG. 3 is a top view showing the utility blade with the head in various pivoted positions.
Figure 4:
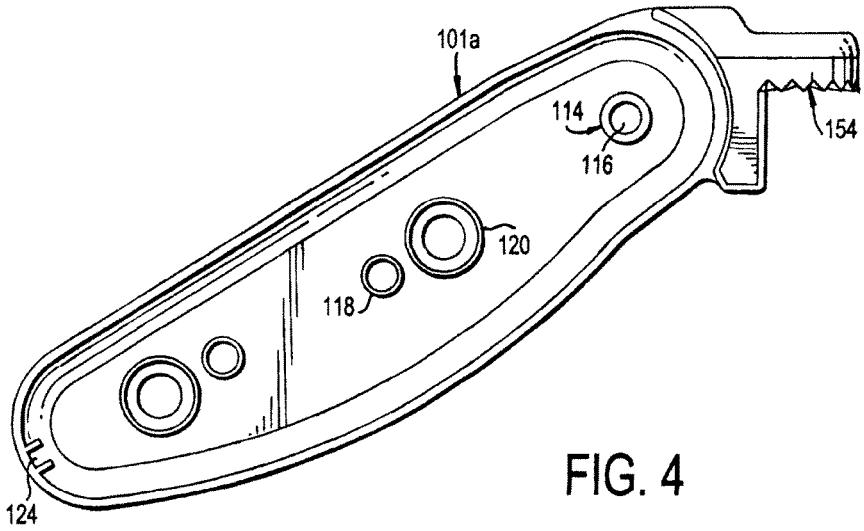
FIG. 4 is a side view of one halve of the handle assembly having the fastening mechanism.
Figure 5:
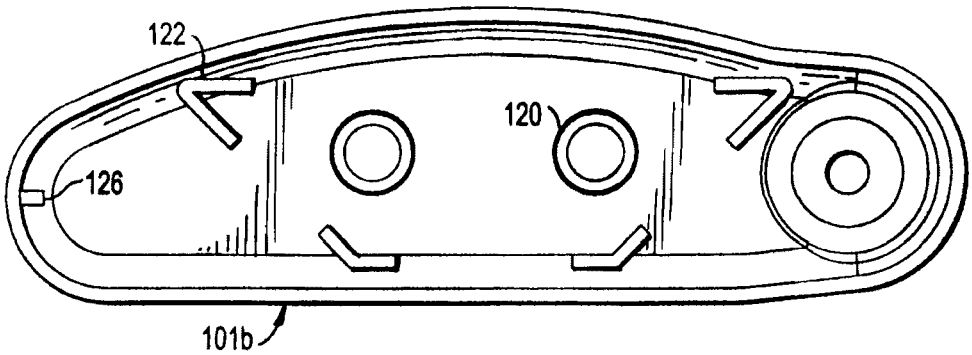
FIG. 5 is a side view of the other halve of the handle assembly.

Referring to FIGS. 3-5, the main body portion 100 is formed as first and second halves 101*a*, 101*b* that engage one another. The main body fastening portion 150 is integrally formed with a first one of the main body halves 101*a*. The second main body halve 101*b* has a threaded standoff 114 with a central through-hole 116 at the proximal end 112. The through-hole 116 receives the threaded lock nut 102 through an opening in the first main body halve 101*a*, which removably couples the main body halves 101*a*, 101*b* together. The lock nut 102 is seated in a recessed portion 103 that surrounds the head of the lock nut 102. The recessed portion 103 can be circular, as shown, though is preferably slightly larger than the screw head 102 and/or oblong to allow the user to reach under the screw 102 head and grab a lever that engages the screw 102 to tighten and loosen the screw 102.

Blade guide members 122 (FIG. 5) are provided at one of the halves 101*b* to retain the blades 5. One or more magnets 120 can be provided to magnetically retain a blade 5 positioned inside the second halve 101*b* for storage. Alignment features 118, such as posts, can be provided at the first halve 101*a* to receive elliptical openings in a carpet blade 5 so that the blades 5 are retained within the guides 122 for storage. Locking features 124 are located in a first half 101*a* that form a slot which receives a locking feature 126 in the second half 101*b* to ensure that the halves 101*a*, 101*b* are properly aligned when coupled together and prevent the distal end from coming free when the halves 101*a*, 101*b* are locked together.

Figure 2:
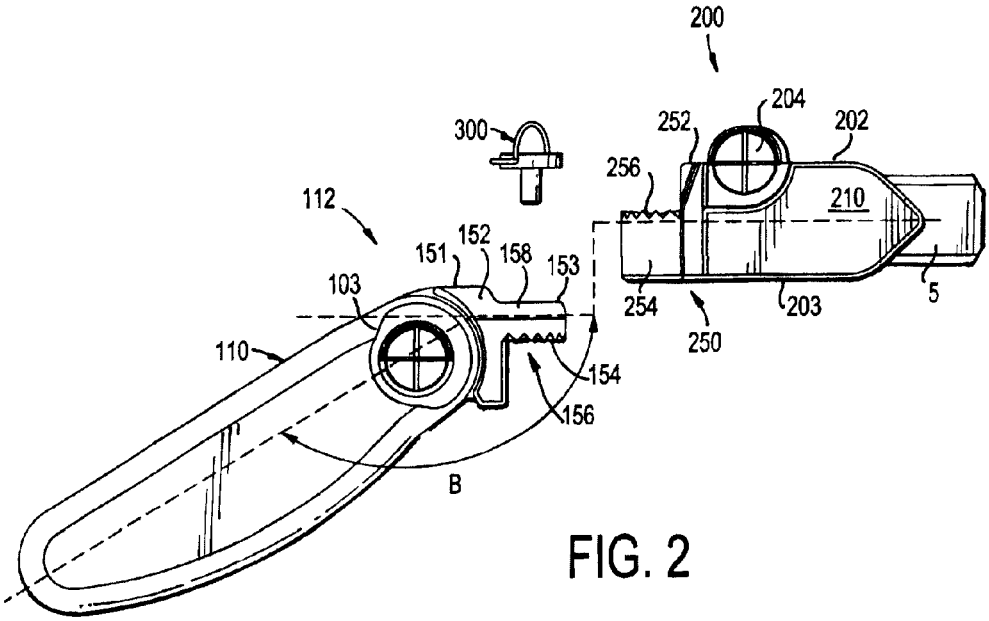
FIG. 2 is a side exploded view of the utility blade of FIG. 1.
Figure 6:
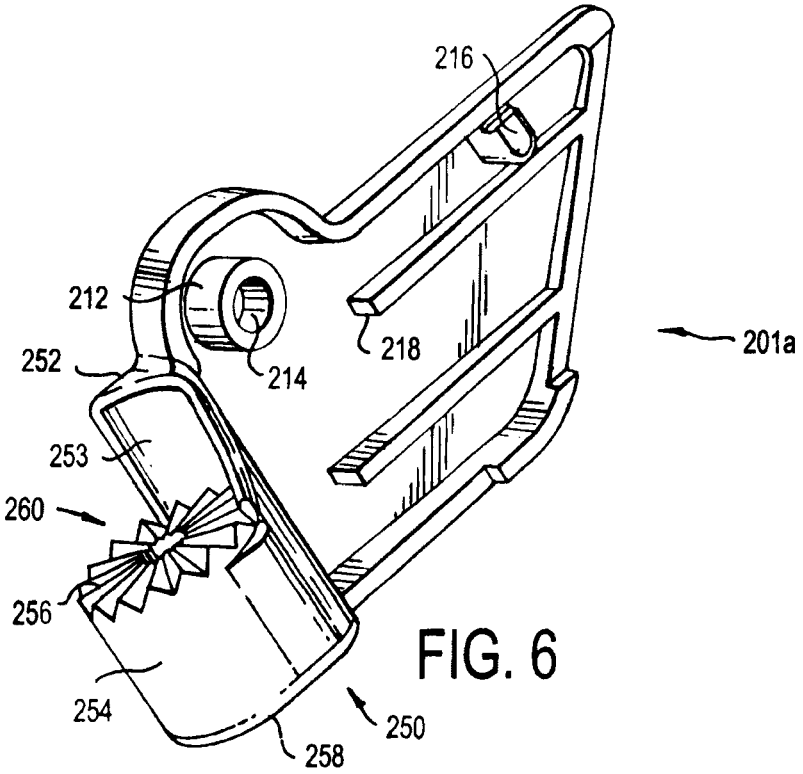
FIG. 6 is one halve of the head assembly having a fastening mechanism.

The head assembly 200 is an elongated member and relatively thin, so as to be sized and shaped to receive a utility blade 5. The head assembly 200 is formed by first and second halves 201*a*, 201*b*, as best shown in FIGS. 3, 6. The head assembly 200 can be, for instance, a carpet head assembly that houses and retains a carpet blade (as shown in FIG. 2) or a box head assembly that houses and retains a standard box blade (as shown in FIG. 1). The head assembly 200 includes a body 210 having a top 202 and a bottom 203.

As shown in FIG. 6, first head assembly halve 201*a* includes a threaded standoff 212 that has a through-hole 214 at the rear of the top end 202 of the body 210. The through-hole 214 receives a lock nut 204 (FIG. 2) that also passes through the second halve 201*b* to removably secure the two halves 201*a, b* of the head assembly 200 together. Thus, the lock nut 204 enables the head assembly halves 201*a, b* to be opened to gain access to the interior of the assembly 200. A worn blade 5 can thereby be removed and a new blade 5 inserted for use. The blade 5 rests against one or more elongated ridges 218 that support the blade 5. An alignment feature 216 couples with an alignment notch in the blade 5 to further retain the blade 5 in the proper position.

As further shown in FIG. 6, a head fastening portion 250 is integrally formed with the first halve 201*a* of the head assembly 200. The head fastening portion 250 includes a support 252 and a circular base member 254. The support 252 is integrally formed at the rear of the first head assembly halve 201*a*. The support 252 extends outward and has a curved inner surface 253 above the base 254. The base 254 has a flat bottom surface 258 and a top surface 256 formed as triangularly-shaped pivot alignment teeth. The base 254 also has a centrally-located threaded opening 260.

Referring back to FIG. 2, the main body fastening portion 150 and the head fastening portion 250 matingly engage one another to thereby pivotally couple the main body portion 100 with the head assembly 200 in a locked relationship. As shown, the shelf 158 of the main body fastening portion 150 and the base 254 of the head portion 250 extend outward toward each other from the main body 110 and the body 210 of the head assembly 200, respectively. The bottom surface 154 of the shelf 158 and the to surface 256 contain alignment teeth that engage one another, so that the head assembly 200 can be positioned at any one of a number of different angles with respect to the main body portion 100 and handle assembly 110. Three illustrative positions are shown, for instance, in FIGS. 1 and 3.

Thus, the head assembly 200 is coupled with the main body portion 100 by aligning the top surface 256 of the base 254 with the bottom surface 154 of the shelf 158. The inner surfaces of the supports 252, 152 are curved to match and receive the respective curved shelf 158 and base 254, respectively. The head assembly 200 is placed at a desired transverse angle with respect to the plane and longitudinal axis of the handle assembly 110. The main body portion 100 and head assembly 200 can then slide together.

Once the assemblies 100, 200 are in the desired position, the threaded locking pin 300 is then inserted to pass through the through-hole 156 of the shelf 158 and into the threaded opening 260 of the base member 254. The pin 300 can then threadably engage the base member 254 to lock the main body portion 100 and handle assembly 110 in the chosen position with respect to the head assembly 200. As noted above, the top surface 153 of the shelf 158 is slightly lower than the top support ledge 151, so that the lock nut 300 is relatively flush with the top of the support 152 when received in the through-hole 156. The user can then rest a finger or thumb on the locking pin 200 during use and to apply the cutting force. To change the angle, the threaded pin 300 can be loosened and the head assembly 200 pivoted, without fully removing the pin 300.

The entire utility knife 10 is formed of rigid material such as metal such as steel, aluminum, stainless steel, zinc, or other material such as plastic or polycarbonate plastic, including the main body 100, head assembly 200 and fastening portions 150, 250. The first and second main body portion halves 101*a, b*, are each formed as a single unitary and integral piece, including that the handle assembly 110 and the main body fastening portion 150 are formed as a single unitary and integral piece with the first main body halve 101*a*. And, the first and second head assembly halves 201*a, b*, are formed as a single unitary and integral piece, including that the head fastening portion 250 is formed as a single unitary and integral piece with the first head assembly halve 201*a*. Of course, the fastening portions 150, 250 can be separately formed and welded to the handle assembly 110 and body 210, respectively. Thus, the fastening portions 150, 250 are rigidly and permanently affixed to the main body 110 and head assembly 200, respectively. Accordingly, the utility knife 10 is a durable and rigid device that is capable of receiving a strong force for the user to apply a strong cutting force. The curved inner surfaces of the supports 152, 252 provide support to the shelf 158 and base 254 when pressure is applied by the user.

Thus, the fastener mechanisms 150, 250 and pin 300 cooperatively provide a pivot about which the head portion 120 can rotate in a transverse direction with respect to the main body 100. That is, from a side view (see arrows AA in FIG. 3), the head assembly 200 rotates to the left and right with respect to the main body 100. The main body 100 and head 200 have a larger width than depth. The wing nut 300 can be loosened, the head 200 positioned with respect to the main body 100, then the wing nut tightened to lock the head 200 into the desired position for use. The fastening portions can also be notched (as shown by the triangular-shaped teeth, so that the head 200 can be set at particular pre-defined positions with respect to the body 100, and the notches better retain the knife 10 in that set position. Further to the preferred embodiment, the head 200 can pivot up to approximately 45° in each direction, for a total swing of about 90°. Of course, any suitable amount of pivot can be provided, greater or less than 45°.

In the embodiments shown, the support 152 is provided at an angle with respect to the handle 110, so that the main body portion 100 has a bend that forms an angle (as noted above, the angle is preferably about 135°-155°, though any suitable angle can be provided). And, the head assembly 200 connects linearly with the support 250. Accordingly, the longitudinal axis of the handle 110 is at an angle with respect to the longitudinal axis of the support 150 and the head portion 200. However, other suitable embodiments can be provided, and the main body 110 need not be bent but can be linear (or planar) with the head portion 200.

Figure 7:
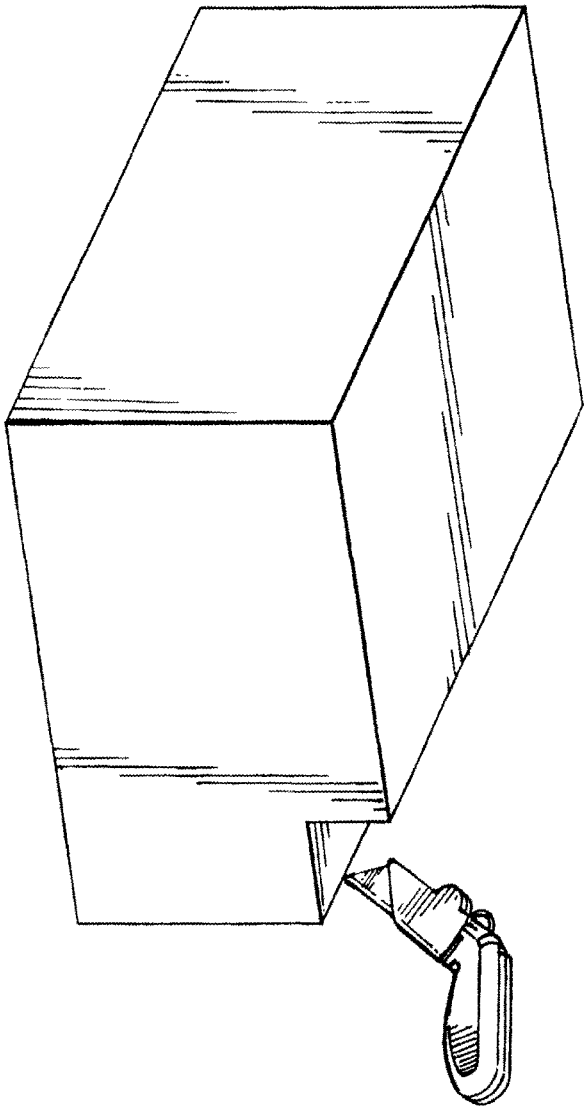
FIG. 7 shows the utility knife for use in a tight space, such as under a cabinet toe kick or other objects that make it difficult to reach to cut.

The head assembly 200 retains the utility blade 5. By pivoting the head assembly 200 with respect to the main body 100, it is easier for the user to reach into tight spaces, such as under a cabinet toe kick, as shown in FIG. 7. As shown, the knife can be angled to better fit under the cabinet toe kick. The knife enables the user to obtain a straight cut with the blade substantially at an orthogonal angle to the cutting surface rather than at an acute angle to the cutting surface. As shown in the figures, the blade body 100 and head portion 200 can be of any suitable type, such as ones that pivot to open up for replacement or storage of blades. Though the head assembly 200 is shown to secure the blade 5 in a fixed position, it should be appreciated that a retractable configuration can also be provided for the head assembly 200, so that the blade 5 can be retracted and extended from the head assembly 200.

Figure 8A:
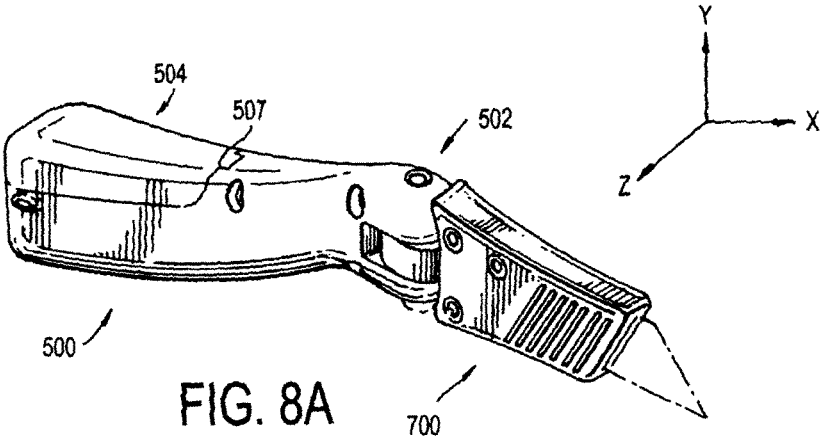
FIG. 8A is a perspective view of another embodiment of the utility knife of the present invention.

Turning to FIG. 8A, another embodiment of the invention is shown. Here, the utility knife 10 is shown having a main body 500 that is ergonomic and provides leverage for cutting. The main body 500 has a front end portion 502 and a rear end portion 504. The main body 500 has a top surface that is relatively flat and smooth and is angled downward slightly as it progresses from the front end portion 502 to the rear end portion 504. In addition, the main body 500 is narrower at the front end portion 502 and gets wider as it progresses to the rear end portion 504. The wider rear end portion 504 provides a larger surface for the user's palm to comfortably exert a downward force, and for the user to grip the main body 500, while the user can simultaneously press down with a thumb or finger at the front end portion 502.

Figure 8B:
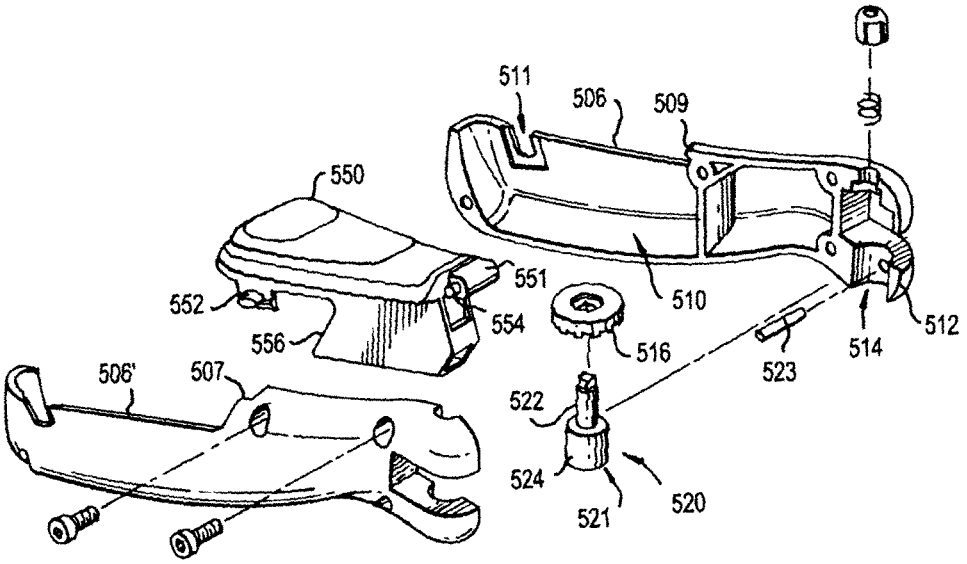
FIG. 8B is an exploded view of the utility knife of FIG. 8A.

Turning to FIG. 8B, the main body 500 is shown in greater detail. The main body 500 has two side portions 506, 506' and a rear center portion 550. The center portion 550 is received at the rear end potion 504 of the side portions 506, 506' and can form the entire width of the main body 500 at the rear end portion 504. The side portions 506, 506' have a cutout section that has a rearward-facing edge with a recessed portion forming ledges 507 that extend parallel to the longitudinal axis of the main body 500. Circular openings or recesses 509 are formed in the ledges 507. The center portion 550 has a connect member 551 that extends outward forward from the front of the center member 550. Two small circular pins or tabs 554 are formed at the opposite sides of the connect member 551. The connect member 551 is received between the two ledges 507 with the tabs 554 facing and aligned with the respective openings 509. When joined, the tabs 554 are rotatably received in the respective openings 509. In this manner, the center member 550 is pivotally connected to the main body 500 about the connect member 551, so that the center member 550 can be pivoted upward to an open position (see FIG. 8E), or downward to a closed position (FIG. 8A). In the open position, the user can access the interior 510 of the main body 500 for storage or the like to form an interior compartment.

The side portions 506 each have a lock opening 511, and a locking tab 552 is provided at each opposing side at the rear end of the center portion 550. The locking tab 552 can be an oval-shaped projection that extends outward from a flexible support member that extends downward from the side of the center portion 550. Each locking tab 552 aligns with and is lockably received in the mating lock opening 511, to releasably lock the center portion 550 to the side portions 506. In the locked position, the locking tabs 552 are received in and locked to the openings 511, and the locking tabs 552 extend outward from the side portions 506. To unlock the center portion 550 and move the center portion 550 into an open position, the user presses inward on the tabs 552 (which are flexibly connected to the center portion 550 by the support member so that the support member can be pushed inward) and lifts upward on the center portion 550, as shown in FIG. 8E. Of course, other suitable releasable locking can be provided, such as that the tabs 552 can slide rearward to engage and disengage the opening 511.

To assemble the main body 500, the side portions 506, 506' are aligned with each other and with the center portion 550. The side portions 506, 506' are joined together with the tabs 554 received in the indents 509. Screws can be placed through one of the side portions 506' into the other side portion 506 to reliably hold the two side portions 506, 506' and the center portion 550 together, while the center portion 550 can rotate upward and downward into the locked position and the open position. The assembled main body 500 has a interior space 510 that can be utilized for storage of replacement and/or used cutting blades or the like.

In one embodiment, the center portion 550 can have a blade storage compartment 556 with two side walls that extend downward from the top of the center portion 550, and a bottom. The side walls are separated from one another to form a slot therebetween. The blade storage compartment 556 can be substantially parallel to the longitudinal axis of the main body 500, and is received in the interior space 510 of the main body 500. When the center portion 550 is in the open position, a user can insert or remove one or more replacement and/or used blades in the slot of the blade storage compartment 556, as shown in FIG. BE. When the center portion 550 is in the closed/locked position, the blades are fully retained in the blade storage compartment 556 at the interior space 510 of the main body 500 and cannot injure the user.

Figure 8C:
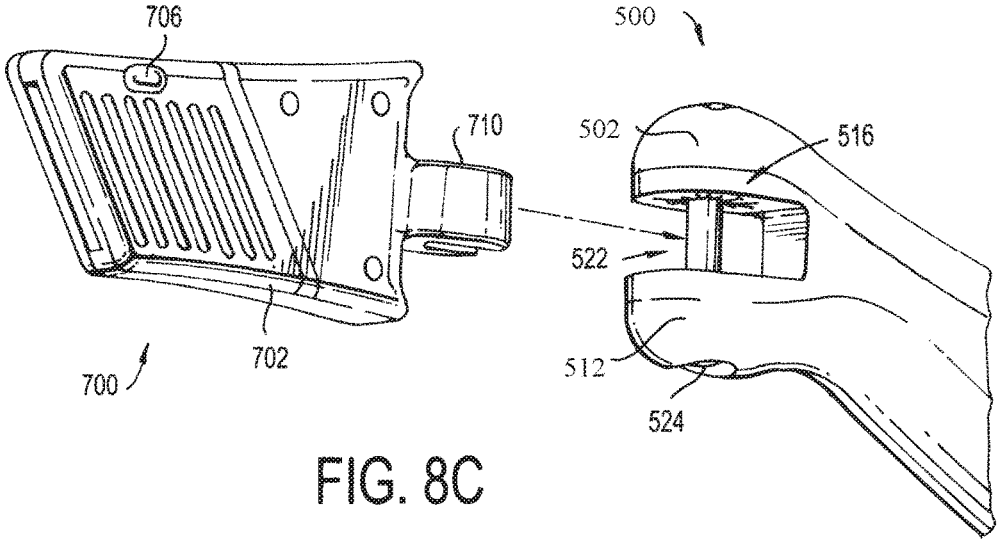
FIG. 8C is a detailed view of the head assembly being mated with the handle.

Referring to FIGS. 8B and 8C, another feature of the invention will be described. The front end 502 of the main body 500 has a rounded head formed by two rounded arms 512 that are separated from one another. When the side portions 506 are joined together, the rounded heads form a central circular opening 514 that extends transversely to the longitudinal axis of the main body 500. A releasable locking mechanism 520 is provided that is received in the opening 514 between the arms 512. The locking mechanism 520 can include an actuator 521, a locking plate 516, a spring and a nut. The actuator 521 can include a base 524 and a shaft 522 extending upward from the base 524. The actuator 521 can move upward and downward with respect to the opening 514 and arms 512. Optionally, the base 524 has a through-hole that receives a locking pin 523. The locking pin 524 is received in recesses in the arms 512 to thereby lock the base 524 to the side arms 512, such as to retain the base in an open position during insertion and/or removal of a head blade assembly 700. When the actuator 521 is depressed, the locking pin 524 can be slid into a side arm to lock the base 524 to the arm and keep the actuator 521 in the depressed position.

The lock plate 516 has a central opening that mates with the shaft 522, whereby the opening and the distal end of the shaft 522 can be square to fixedly couple the shaft 522 with the lock plate 516. The lock plate 516 has a bottom surface formed with mating or locking grooves. When assembled (FIG. 8C), the lock plate 516 is received in the space formed between the upper arms 512, with the spring and nut above the lock plate 516, the base 524 locked to the lower arms 512, and the shaft 522 extending from the upper arms 512 to the lower arms 512. When the actuator 521 is in an un-depressed position, the actuator 521 is forced downward by operation of the spring pushing against the nut, so that the bottom of the base 524 extends below the lower arms. And, the lock plate 516 is in the downward position. The user can then depress the actuator 521 via the base 524 upward against the force of the spring. This in turn moves the shaft 522 and the lock plate 516 into an upward position where the lock plate 516 is fully recessed in the upper arms, as shown in FIG. 8C. Thus, the actuator 521 freely slides within the openings 514. One end of the spring connects to the nut (screw) and the other end of the spring connects to the lock plate 516 so that the actuator 521 does not come free of the opening 514.

Figure 8D:
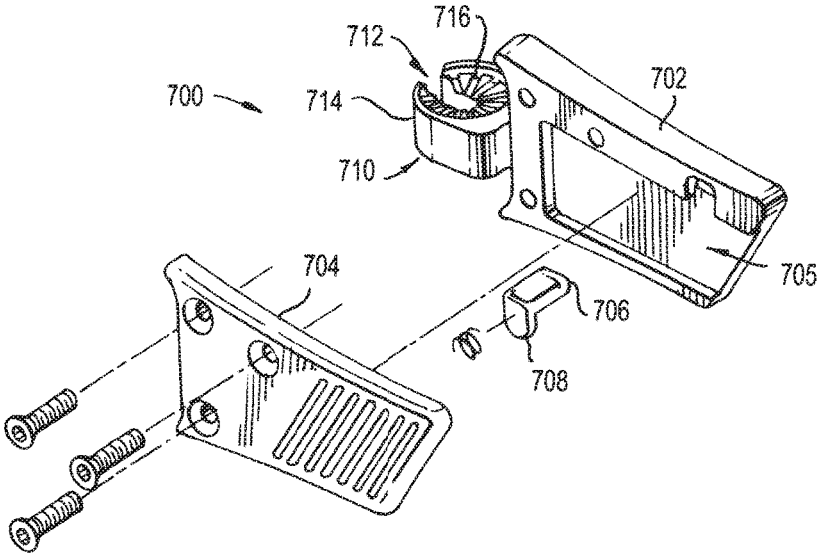
FIG. 8D is an exploded view of the utility knife blade assembly.
Figure 8E:
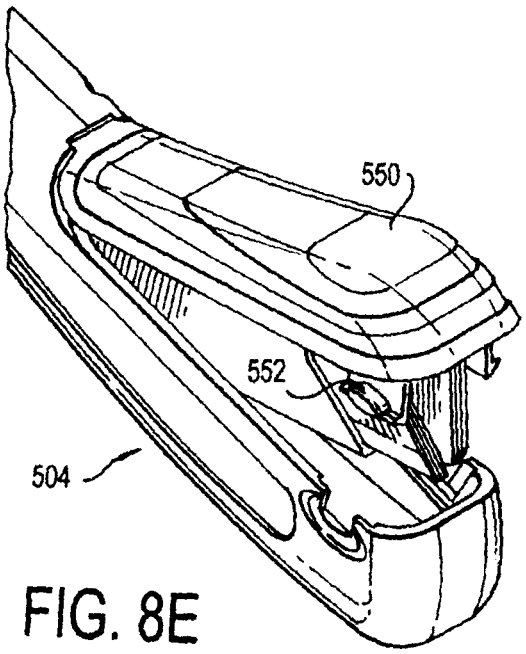
FIG. 8E is a perspective view showing the compartment opening at the rear end of the handle.

Turning momentarily to FIG. 8D, a head assembly 700 is provided having a main body 702 with a circular grip 710. The grip 710 has two semi-circular arms 714 that extend from the rear end of the main body 702. The main body 702 can be relatively flat in a Y-plane, whereas the longitudinal axis of the main body 500 is in the X-direction and the arms 714 extend in the X-direction. The arms 714 come partly together and form a slot 712 therebetween. The arms 714 have an upper surface with mating grooves 716.

Returning to FIG. 8C, the operation for a quick release to join the head assembly 700 with the front end portion 502 will be discussed. The user depresses the bottom of the actuator 521 upward, which forces the lock plate 516 upward to be recessed within the upper arms 512. The grip 712 of the head assembly 700 can then be inserted between the upper and lower arms 512, with the shaft 522 being received in the slot 712. Once the head assembly 700 is fully seated on the shaft 522, the user releases the shaft 522. The spring pushes the lock plate 516 and shaft 522 downward, thereby removably and lockingly engaging the mating structure (such as the shown at least one tongue and/or groove) on the bottom surface of the lock plate 516 with the mating structure (such as the at least one tongue and/or groove) 716 on the top surface of the grip 710, thereby locking the head assembly 700 to the front end portion 502. The user can then depress the shaft 522 to remove the head assembly 700 or to pivot the head assembly 700 (about the Y-axis) to a different position or angle with respect to the main body 500. Thus, the user can quickly and reliably insert and remove head assemblies 700 having different shapes or functions to the main body 500, such as the head assemblies shown in FIGS. 8A, 10A, and 11A.

Figure 9:
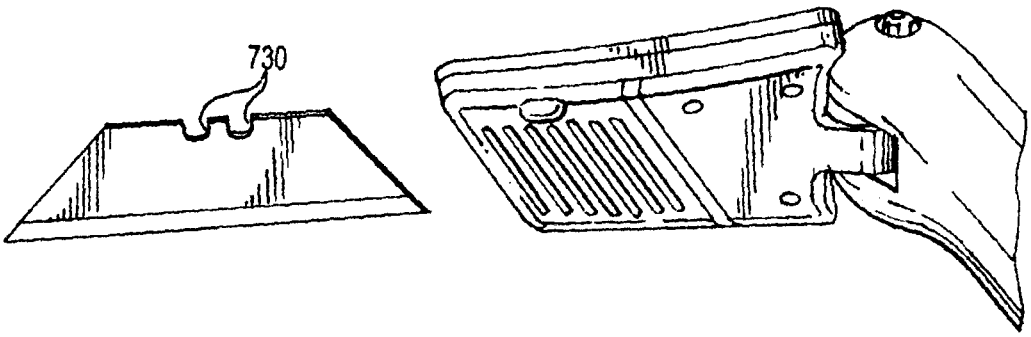
FIG. 9 is a perspective view showing operation of the knife blade head assembly mating with the utility blade.

Referring now to FIGS. 8D and 9, another feature of the invention is shown, whereby a quick locking release is provided for the head assembly 710 to quickly lock and release cutting blades. The head assembly 710 has two side walls 702, 704. A small recess 705 is provided in one or both of the walls 702, 704 to form an opening that can receive a cutting blade when the side walls 702, 704 are joined together. A tab is provided having a flat base 708 and a head 706 extending outward from the base 708. The tab is positioned with the head 706 extending through an opening at a top of the first side wall 702 and the base 708 facing the second side wall 704. A spring is positioned between the second side wall 704 and the base 708. The base 708 has a rounded shape that conforms with notches 730 in the blade. Accordingly, to insert a new blade into the head assembly 700, the user presses the head 706 of the tab inward and inserts the blade into the opening formed by the recess 705. Once the blade is fully inserted, the user releases the head 706 and the spring forces the base 708 to align with the opening formed by the recess and thereby the base 708 aligns with and engages the notches 730 of the blade, thereby locking the blade in the head assembly 700. The base 708 can engage either of the two notches 730, depending on the length of the blade that the user wants to extend from the head assembly 700. Thus, the user can quickly and reliably insert and remove blades in the head assembly 700.

Figure 10A:
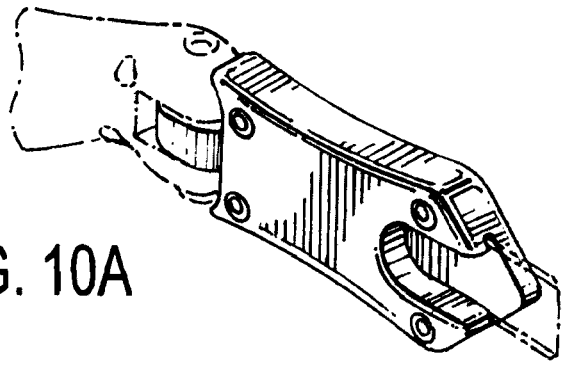
FIG. 10A is a perspective view of another embodiment of a utility knife blade head assembly.
Figure 10B:
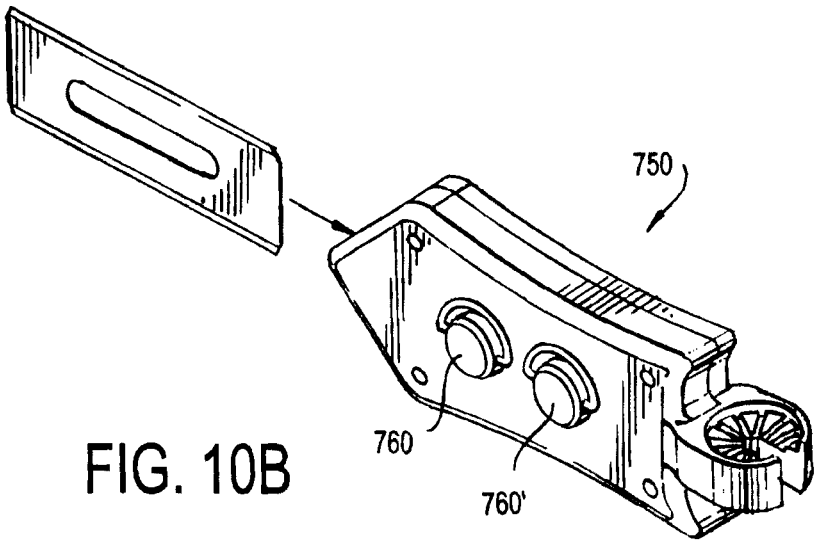
FIG. 10B shows operation of the head assembly of FIG. 10A.
Figure 10C:
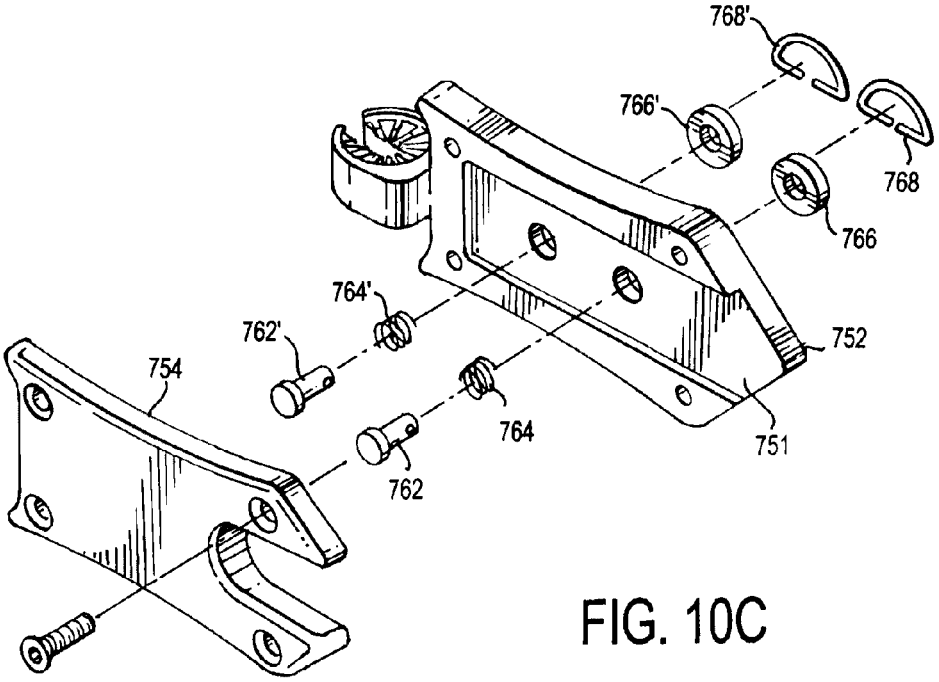
FIG. 10C is an exploded view of the knife blade assembly of FIG. 10A.

Turning to FIGS. 10A-10C, another head assembly 750 is shown for use with a dual-edge knife blade with a quick release assembly. The head assembly 750 has a first side portion 752 and a second side portion 754 that are fastened together by screws or the like. This head assembly 750 is similar to the one shown in FIGS. 8D, 9, but here the tab is replaced by two engagement pins 762 and the spring 764 is positioned between the pin head and the first side wall 752. The spring 764 is received over the shaft of the pin 762. The shaft extends through an opening in the first side wall 752, through a washer 766, and is engaged by a pin handle 768 that enters an opening in the distal end of the shaft. In operation, the user pulls outward on the pin handle 768 of the first locking mechanism 760. That pulls the pin head inward toward the first side wall 752 against the force of the spring 764 until the pin head is recessed in the opening. The knife blade can then be slid into the opening created by the recess(es) 751 in the inner portion of the side wall(s) 752, 754. The leading end of the knife blade will contact the second locking mechanism 760', so that it cannot extend further into the recess 751. And the elongated slot will engage the shaft of the pin 762 so that the blade does not slide out of the recess 751.

At that point, the user can release the first locking mechanism 760, whereby the head of the pin 762 will enter the opening formed by the recess 751 and extend through the elongated slot in the knife blade and come to rest on the surface of the second side wall 754. This locks the blade to the head assembly 750. At this point, the user can choose to pull on the second locking mechanism 760' if the user desires to have a shorter length of the blade extend from the head assembly 750. That will recess the pin 762' in the opening of the first side wall 752 against the force of the spring 764', and the user can push the blade further into the recess 751. Once the blade is fully received, the second mechanism 760' is released, and the pin enters the elongated slot of the blade. To remove the blade, the locking mechanisms 760, 760' are pulled outward and the blade is slid out of the recess 751. The second wall 754 can have a U-shaped cutout that enables the user to grip the blade and slide the blade out of the recess 751.

Figure 11A:
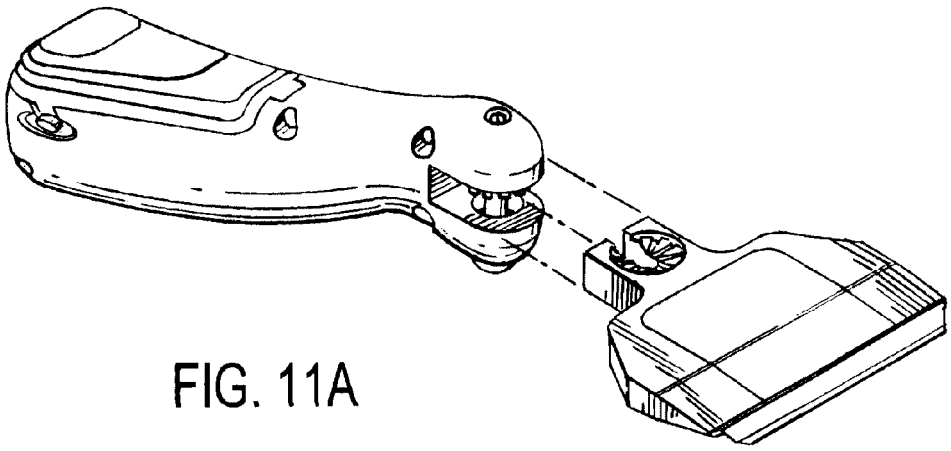
FIG. 11A is a view of a head assembly in accordance with another embodiment of the invention.
Figure 11B:
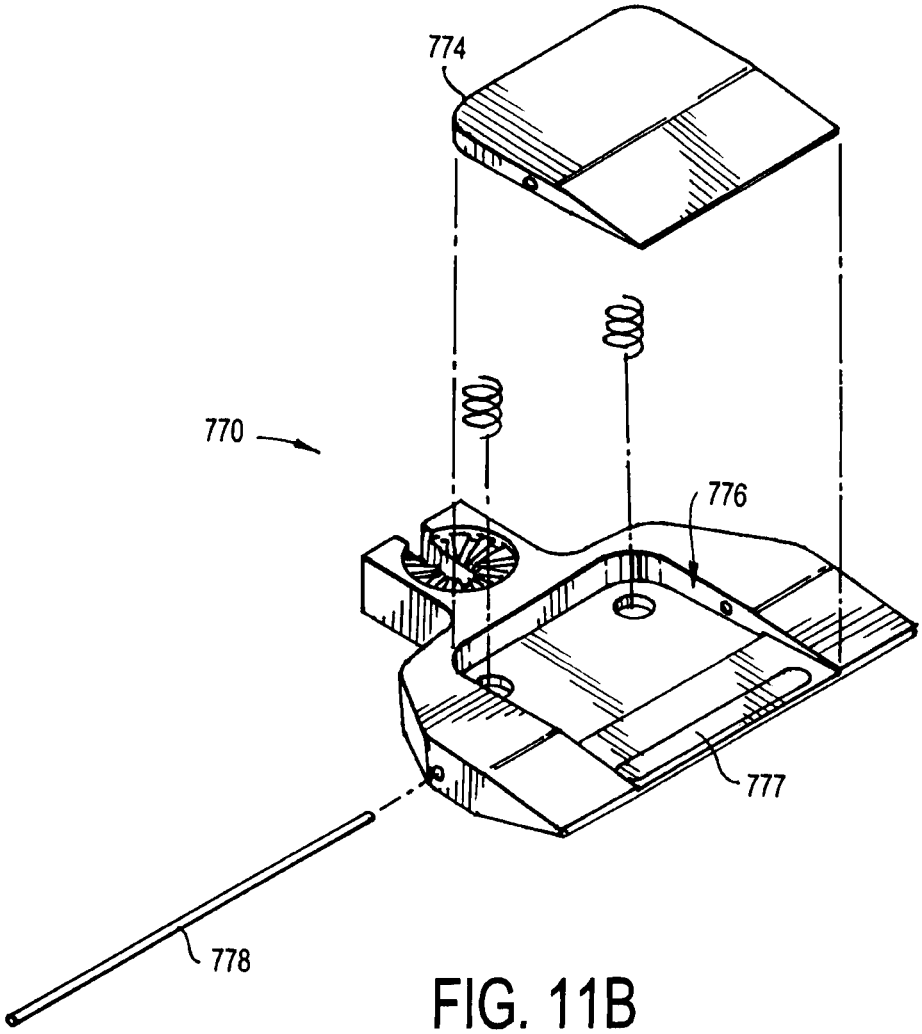
FIG. 11B is an exploded view of the head assembly of FIG. 11A.

Referring to FIGS. 11A, 11B, 11C another embodiment of the head assembly 770 is shown for use as a scraper with a scraper blade and a quick release. The head assembly 770 includes a main body 772 and a cover plate 774. The main body 772 is formed in the shape of a scraper and has a leading edge. The main body 772 can be tapered and angled downward toward the leading edge. The main body 772 has a slit at the leading edge and a recessed portion 776. The cover plate is received in the recessed portion 776 and one or more springs are positioned at the rear of the cover plate 774 between the cover plate 774 and the main body 772. The spring(s) can be fitted in round channels that prevent the springs from moving. The cover plate 774 has a transverse through-hole that aligns with a through-hole in the main body 772. A pin 778 extends through the main body through-hole and the cover plate through-hole to pivotally connect the cover plate 774 to the main body 772. The recess 776 can have a lock bar 777 that extends up from the surface of the recess 776 to engage an elongated slot in a blade, such as the blade shown in FIG. 10B.

In operation, the user presses on the rear end of the cover plate 774. That forces the rear end of the cover plate 774 downward against the force of the springs, and the front end of the cover plate 774 pivots upward about the pin 778 and any angle in the cover plate 774. When the cover plate 774 is depressed, the blade can be inserted into the slit at the front edge and the elongated slot engages the lock bar 777. The user then releases the cover plate 774, whereby the springs push upward on the rear end of the cover plate 774 and the front end of the cover plate 774 pivots downward to prevent the blade from coming free of the lock bar 777. The blade will extend forward from the leading edge of the head assembly 770. To release the blade, the user depresses the rear end of the cover plate 774 and lifts the blade off of the lock bar 777. In this manner, the blade can be quickly and reliably inserted and removed from the head assembly 770.

It is further noted that each of the following features can be used together or separately without the other: the quick release mechanism for connecting the grip main body 500 with the head assembly 700 (FIG. 8A), the rear center portion with compartment and blade storage (FIG. 8E), the quick blade release for the head assembly (FIG. 8D, 10B), and the scraper quick blade release (FIG. 11B).

The invention has been shown and described for use with a head assembly 200 that includes a utility blade or carpet blade. In another embodiment of the invention, the entire head assembly 200 can be removed from the main body portion 100 and replaced with a head assembly corresponding to any number of different types of tools, such as scrapers, chisels, tile grout grinder, etc.

As shown and described, the knife preferably pivots in a single dimension, i.e. from side-to-side (left to right; or transverse to the front surface of the main body 100 or the head portion 200) when viewed from the side (as during 8 use). In other words, the head assembly 200 and the handle assembly 110 each have two opposing sides, a top and a bottom. The head assembly pivots in the direction that the head assembly sides are facing, toward one of the sides of the handle assembly. The user can push down on the knife without it creating a side-to-side force that pushes the head out of position. However, other suitable fastening mechanisms can be provided, such as allowing the head portion 200 to pivot or swing in other dimensions or directions with respect to the main body 100.

It is noted that the handle assembly 110 and the head assembly 200 have been shown and described as having two separate halves, and that the respective handle assembly fastening mechanism 150 and the head assembly fastening mechanism 250 are integrated with one of each of the halves. It should be recognized, however, that other suitable configurations can be provided. For instance, the main body portion 100 (including the handle assembly 110) can be a single closed unitary device that does not open, and the main body fastening mechanism 150 can be a single integral one-piece member. In addition, while the present invention allows for pivoting of the head assembly 200, the knife 10 can be provided with the head assembly 200 at a preset angle with respect to the handle assembly, that cannot be pivoted or adjusted.

As shown and described, a utility knife is provided with improved ergonomics to be able to cut an object at different angles. The knife is flexible to permit the user to maneuver the tool when cutting any surface. One example is cutting at an angle where a right handed person might otherwise have to use their left hand (weak hand) to reach the cutting area. The pivoting head of the present invention remedies this problem since the user can instead use their right hand (dominant hand) to make the necessary cut. It will be appreciated, however, that although the invention is especially useful in tight spaces, the invention is not limited to use in tight spaces.

It is further noted that while the quick-release embodiments shown in FIGS. 8-11 have a head assembly that can pivot with respect to the main body, those embodiments need not be able to pivot but rather can have predetermined relationship with respect of the main body.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A utility knife comprising:

a head assembly comprising a blade, a main body and a grip extending outward from said main body, said grip having a first mating structure with a first mating surface, said grip being circular and having a slot, and said first mating surface forms an upper surface with first teeth;

a handle assembly comprising a main body with a front end, a first longitudinal side and a second longitudinal side, said handle assembly defining a longitudinal axis, wherein the front end includes an interior-facing recess, said recess having a closed top and an interior-facing opened bottom, and wherein the front end of said handle assembly has an upper arm and a lower arm separated from the upper arm; and a releasable locking mechanism at the front end of said handle assembly, said releasable locking mechanism having a locking plate with a second mating structure having a second mating surface forming a bottom surface with second teeth, said releasable locking mechanism further having an actuator, said actuator comprising:

a base having an opening;

a pin removably received in said opening to lock the base to the front end of said handle assembly; and a shaft fixedly coupled with the locking plate, the shaft extending from the lower arm to the upper arm and received in the slot to move the locking plate between a first position and a second position different from the first position, whereby in the first position the second mating structure of the locking plate extends out of the recess so that the second mating surface lockingly engages the first mating surface whereby said first teeth matingly engage said second teeth in the first position, and whereby in the second position the locking plate is at least partly received in the recess portion so that the second mating surface disengages the first mating surface, and wherein said releasable locking mechanism pivotally couples said head assembly and said handle assembly such that said head assembly pivots in a side-to-side direction with respect to the first and second longitudinal sides of the main body of said handle assembly and with respect to the longitudinal axis of the main body of said handle assembly.

2. The knife of claim 1, wherein said releasable locking mechanism further includes a spring located in the recess for biasing the locking plate in the first position.

3. The knife of claim 1, wherein said grip has a top surface and the first mating surface is located on the top surface, and said locking plate has a bottom surface and the second mating surface is located on the bottom surface.

4. A utility knife comprising:

a head portion configured to removably receive a separate discrete blade, said head portion having a fastening plate extending in a plane that is transverse to the blade, said fastening plate having an upper mating surface formed with first mating teeth and said fastening plate being circular and having a slot;

a main body portion separate from the head portion, said main body portion having an upper arm and a lower arm, each of the upper arm and lower arm extending in a plane that is transverse to the blade and separated by a gap that receives the fastening plate to provide a releasable fastening mechanism that pivotally connects said head portion to said main body portion, said upper arm further having a recess with a closed top and an interior-facing open bottom;

a releasable locking mechanism positioned between the upper arm and the lower arm, the locking mechanism having a base with an opening and a locking plate with a lower mating surface formed with second mating teeth, and a shaft for moving the locking plate between a first position whereby the second mating teeth lockingly engage the first mating teeth, and a second position whereby the second mating teeth disengage the first mating teeth; and a pin received in the opening of said base to lock the base to the lower arm of the main body.

5. The utility knife of claim 4, wherein said head portion can pivot about said fastening mechanism in a side-to-side direction with respect to the main body portion.

6. The utility knife of claim 4, further comprising a handle formed in at least a portion of said main body portion.

7. The utility knife of claim 4, wherein said utility knife is made entirely of metal and is rigid.

8. The utility knife of claim 4, wherein said head portion has a central longitudinal axis and said main body portion has a central longitudinal axis, and wherein the central longitudinal axis of said head portion is at an angle with respect to the central longitudinal axis of said main body portion.

9. The utility knife of claim 8, wherein said angle is between 135°-155°.

10. The utility knife of claim 8, wherein said angle is 1450.

11. The utility knife of claim 4, wherein the blade has a blade plane and the fastening plate is in a fastening plate plane that is orthogonal to the blade plane, and wherein the gap is coplanar with the fastening plate plane.

12. The utility knife of claim 4, wherein the main body defines the horizontal plane.

* * * * *